US010143271B2

(12) United States Patent
Zhang et al.

(10) Patent No.: US 10,143,271 B2
(45) Date of Patent: Dec. 4, 2018

(54) SMART WATCH AND AUTOMATIC WEARING METHOD THEREOF

(71) Applicant: ZTE CORPORATION, Shenzhen (CN)

(72) Inventors: Wei Zhang, Shenzhen (CN); Jianshan Fu, Shenzhen (CN)

(73) Assignee: XI'AN ZHONGXING NEW SOFTWARE CO., LTD, Shaanxi (CN)

( * ) Notice: Subject to any disclaimer, the term of this patent is extended or adjusted under 35 U.S.C. 154(b) by 161 days.

(21) Appl. No.: 15/319,835

(22) PCT Filed: Oct. 27, 2014

(86) PCT No.: PCT/CN2014/089594
§ 371 (c)(1),
(2) Date: Dec. 19, 2016

(87) PCT Pub. No.: WO2015/192580
PCT Pub. Date: Dec. 23, 2015

(65) Prior Publication Data

US 2017/0135449 A1 May 18, 2017

(30) Foreign Application Priority Data

Jun. 17, 2014 (CN) ..... 2014 1 0269780

(51) Int. Cl.
*A44C 5/04* (2006.01)
*G04B 47/06* (2006.01)
(Continued)

(52) U.S. Cl.
CPC ..... *A44C 5/04* (2013.01); *A44C 5/00* (2013.01); *G04B 37/1486* (2013.01);
(Continued)

(58) Field of Classification Search
CPC .. A44C 5/04; A44C 5/00; A44C 5/147; G04G 17/00; G04G 21/02; G04B 47/068;
(Continued)

(56) References Cited

U.S. PATENT DOCUMENTS 4,977,614 A * 12/1990 Kurcbart ..... A44C 5/00 340/7.63
8,370,998 B2 2/2013 Han et al.
(Continued)

FOREIGN PATENT DOCUMENTS

CN 201152935 Y 11/2008
CN 101961161 A 2/2011
CN 102740721 A 10/2012

OTHER PUBLICATIONS

PCT International Search Report dated Mar. 23, 2015, Application No. PCT/CN2014/089594, 4 Pages.
(Continued)

*Primary Examiner* — Robert Sandy
*Assistant Examiner* — Rowland Do
(74) *Attorney, Agent, or Firm* — Plumsea Law Group, LLC

(57) ABSTRACT

A smart watch includes: a watch dial, a watch band, a monitoring apparatus, and a mechanical transmission apparatus; herein, sensors are set on both front and back surfaces of the watch dial; the watch band is made of hard material and has a multi-section structure; and beginning from a first section of watch band fixedly connected to the watch dial, each section of watch band is a hollow cavity structure that accommodates a next section of watch band; the monitoring apparatus is deployed within the watch dial; the mechanical transmission apparatus is set between the watch dial and the watch band, and is arranged to control extension or retraction of other sections of watch bands for automatically
(Continued)

wearing or removal of the watch band. A smart watch automatic wearing method is further provided.

20 Claims, 4 Drawing Sheets

(51) Int. Cl.

| | |
|---|---|
| ***G04B 37/14*** | (2006.01) |
| ***A44C 5/00*** | (2006.01) |
| ***G04G 21/02*** | (2010.01) |
| ***G04G 17/00*** | (2013.01) |

(52) U.S. Cl.
CPC ..... *G04B 47/068* (2013.01); *G04G 17/00* (2013.01); *G04G 21/02* (2013.01)

(58) Field of Classification Search
CPC ..... G04B 37/1486; Y10T 24/4782; A44D 2203/00
See application file for complete search history.

(56) References Cited

U.S. PATENT DOCUMENTS

| | | | | |
|---|---|---|---|---|
| 8,910,348 | B2 | 12/2014 | Schenk | |
| 9,052,695 | B1 * | 6/2015 | Fedan | A44C 5/147 |
| 2002/0017539 | A1 | 2/2002 | Rota | |
| 2003/0182770 | A1 * | 10/2003 | Koshoji | A44C 5/0015 24/265 WS |
| 2010/0302914 | A1 * | 12/2010 | Faucher | A44C 5/147 368/282 |
| 2011/0099771 | A1 | 5/2011 | Grossenbacher et al. | |

OTHER PUBLICATIONS

Extended European Search Report dated May 17, 2017, Application No. 14894998.5-1559, Applicant ZTE Corporation, 6 Pages.

* cited by examiner

SMART WATCH AND AUTOMATIC WEARING METHOD THEREOF

CROSS-REFERENCE TO RELATED APPLICATIONS

This application is the U.S. national phase of PCT Application No. PCT/CN2014/089594 filed on Oct. 27, 2014, which claims priority to Chinese Patent Application No. 201410269780.X filed on Jun. 17, 2014, the disclosures of which are incorporated in their entirety by reference herein.

TECHNICAL FIELD

The present document relates to the terminal field, and in particular, to a smart watch and automatic wearing method for the smart watch.

BACKGROUND

The smart watch is a watch with a built-in intelligent system (or with a smart phone system) which is connected to the Internet to realize multiple functions, and in some cases, it can synchronize the phone calls, messages, emails, photos, music, etc., in the mobile phone. The smart watches on the market currently can be roughly divided into two kinds:

one is not with the phone call function, it depends on connecting to the smart phones to realize the multiple functions, and can synchronize and operate the phone calls, messages, emails, photos, music, etc., in the mobile phone; the other is with the phone call function, and it supports inserting an SIM card, and which is essentially a smart phone in the form of a watch.

However, although the functions of existing smart watches are so powerful, the wearing and removal of a smart watch is not smart enough, and the user still needs to manually wear and remove the smart watch, the wearing procedure of the existing smart watch is same as that of the normal watch, thereby user experience is greatly reduced.

SUMMARY

The embodiment of the present document provides a smart watch and an automatic wearing method for the smart watch, to at least resolve the problem that although the functions of existing smart watches are so powerful, the wearing and removal of a smart watch is not smart enough, and the user still needs to manually wear and remove the smart watch, the wearing procedure of existing smart watch is same as that of a normal watch, thereby the user experience is greatly reduced.

In order to solve the above technical problem, on one aspect, the present document provides a smart watch, including: a watch dial, a watch band, a monitoring apparatus and a mechanical transmission apparatus; herein, a front surface and a rear surface of the watch dial are respectively set with sensors, and the sensors include: temperature sensors and optical sensors; and the watch band is made of a hard material and has a multi-section structure; and beginning from a first section of the watch band fixedly connected to the watch dial, each section of the watch band is a hollow cavity structure that accommodates a next section of the watch band, to enable all other sections of the watch band except the first section of the watch band retract into previous sections of the watch band;

the monitoring apparatus is set in the watch dial, and arranged to monitor temperature and light intensity of the sensors on the front surface and/or the rear surface of the watch dial, and judge whether the temperature and light intensity reach preset thresholds; the mechanical transmission apparatus is set between the watch dial and the watch band, and is arranged to, when both the temperature and the light intensity reach the preset thresholds, control other sections of the watch band except the first section of the watch band to extend or retract, to automatically remove and wear the watch band.

The smart watch further includes: the monitoring apparatus further arranged to monitor whether a mutual approaching distance between last sections of the watch band at both ends of the watch band reaches a preset distance; and an electromagnet apparatus, arranged to be powered on under a condition that the mutual approaching distance reaches the preset distance, and quickly merge the last sections of both ends of the watch band through a magnetic force after being powered on, to make the watch band to be closed up.

Herein, the monitoring apparatus is further configured to, after the electromagnet apparatus is powered on, monitor temperature and light intensity of the sensors on the front surface of the watch dial, and judge whether the temperature and light intensity reach preset thresholds; and the electromagnet apparatus is further arranged to be powered down under a condition that both the temperature and the light intensity reach the preset thresholds, to remove the magnetic force and make the last sections of both ends of the watch band to be separated.

A number of the temperature sensors is 4, and a number of the optical sensor is 4.

The mechanical transmission apparatus includes: a motor and a gear set in the watch dial, and a plurality of rollers and belts set in the watch band, herein, the belts are wrapped out of the plurality of rollers; the motor is arranged to drive the gear to rotate, and the gear drives the belts, to realize retraction of a plurality of sections of the watch band.

The electromagnet apparatus includes: a battery in the watch dial, a wire loop in the watch band and an electromagnet set in the last section of the watch band.

On the other hand, the embodiment of the present document further provides an automatic wearing method for a smart watch, applied to the above smart watch, including: monitoring temperature and light intensity of sensors on a front surface and/or a rear surface of a watch dial, judging whether both the temperature and the light intensity reach preset thresholds; herein, the sensors include: temperature sensors and optical sensors; and when both the temperature and the light intensity reach the preset thresholds, adjusting other sections of a watch band except a first section of the watch band to extend or retract through a mechanical transmission apparatus, to automatically remove and wear the watch band.

Herein, monitoring temperature and light intensity of sensors on a front surface and/or a rear surface of a watch dial, and judging whether the temperature and the light intensity reach preset thresholds includes: monitoring the sensors on the rear surface of the watch dial, and judging whether the temperature reaches a first preset temperature threshold and the light intensity reaches a first preset light threshold, when both the temperature and the light intensity reach the above threshold, extending each section of the watch band from a cavity of a previous section of the watch band through a mechanical transmission apparatus; and/or, monitoring the sensors on the front surface of the watch dial, and judging whether the temperature reaches a second preset temperature threshold and the light intensity reaches a second preset light threshold, when both the temperature and the light intensity reach the above thresholds, retracting each section of the watch band from the cavity of the previous section of the watch band through the mechanical transmission apparatus.

After extending each section of the watch band from the cavity of the previous section of the watch band through the mechanical transmission apparatus, the method further includes: when a mutual approaching distance between last sections of both ends of the watch band reaches a preset distance, triggering an electromagnet apparatus to be powered on, to generate magnetic force and quickly merge the last sections of both ends of the watch band, to make the watch band to be closed up.

Before retracting each section of the watch band from the cavity of the previous section of the watch band through the mechanical transmission apparatus, the method further includes: under a condition that the temperature of the front surface of the watch dial reaches the second preset temperature threshold and the light intensity reaches the second preset light threshold, controlling the electromagnet apparatus to be powered down, to remove the magnetic force and make the last sections of both ends of the watch band to be separated.

The embodiment of the present document acquires current temperature and light intensity through the sensors, uses the monitoring apparatus to judge whether both temperature and light intensity reach preset thresholds, and under the condition of reaching the preset thresholds, controls extension and retraction of other sections of the watch band except the first section of the watch band through the mechanical transmission apparatus, to realize the function of automatic wearing or removal of the watch band, improve the performance of the smart watch, and fully achieve complete intelligence, and resolve the problem that although the functions of existing smart watches are so powerful, the wearing and removal of a smart watch is not smart enough, and the user still needs to manually wear and remove the smart watch, the wearing procedure of which is the same as that of a normal watch, and the user experience is thus greatly reduced.

SPECIFIC EMBODIMENT

In order to resolve the problem that although the functions of existing smart watches are so strong, the wearing and removal of a smart watch is not smart enough, and the user still needs to manually wear and remove the smart watch, the wearing procedure of the smart watch is the same as that of a normal watch, and the user experience is thus greatly reduced, the embodiment of the present document provides a smart watch and an automatic wearing method for the smart watch, and the present document is further illustrated in details by combining with the accompanying drawings and the embodiments. It should be understood that the specific embodiments described herein are only used for interpreting the present document and are not intended to limit the present document.

Figure 1:
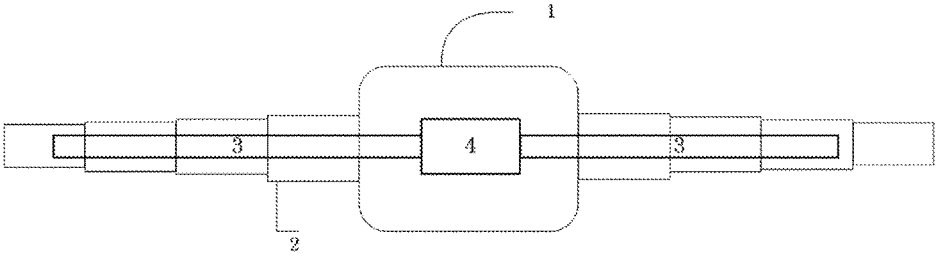
FIG. 1 is a structure diagram of a smart watch according to an embodiment of the present document.

The embodiment of the present document provides a smart watch, and its structure diagram is as shown in FIG. 1, which includes:

watch dial 1, watch band 2, monitoring apparatus 3 and mechanical transmission apparatus 4; herein, sensors are set on both front and rear surfaces of the watch dial, and the sensors include: temperature sensors and optical sensors; the watch band is made of a hard material and has a multi-section structure; and beginning from a first section of watch band fixedly connected to the watch dial, each section of watch band is a hollow cavity structure that can accommodate a next section of watch band, to enable all other sections of the watch band except the first section of the watch band retract into previous sections of the watch band;

the monitoring apparatus is set in the watch dial, and arranged to monitor temperature and light intensity of the sensors on the front and/or rear surfaces of the watch dial and judge whether the temperature and light intensity reach preset thresholds; and the mechanical transmission apparatus is set between the watch dial and the watch band, and is arranged to control other sections of the watch band except the first section of the watch band to extend or retract in a situation when both the temperature and the light intensity reach the preset thresholds, to automatically remove the watch band.

In FIG. 1, positions of the temperature sensors and the light sensors are not shown, while only a position diagram of each main apparatus is shown. Those skilled in the art can change position of each apparatus in FIG. 1 according to the actual needs; of course, the sensors can also be set with different number according to the needs, and can also be set in different positions; the watch dial can be designed as two sections, etc.

The embodiment of the present document acquires current temperature and light intensity through the sensors, uses the monitoring apparatus to judge whether both temperature and light intensity reach preset thresholds, and controls extension and retraction of other sections of the watch band except the first section of the watch band through the mechanical transmission apparatus under the situation of reaching the preset thresholds, to realize the function of automatic wearing or removal of the watch band, improve the performance of the smart watch, and fully achieve complete intelligence, and resolve the problem that although the functions of existing smart watches are so powerful, the wearing and removal of a smart watch is not smart enough, and the user still needs to manually wear and remove the smart watch, the wearing procedure of the smart watch is the same as that of a normal watch, which greatly reducing the user experience.

When the watch bands move close to each other, it is ok as long as the distance between the last sections of both ends of the watch band satisfies that the watch is not to be dropped, that is, the last sections of both ends of the watch band can be not connected. However, in order to further increase the firmness when wearing the watch band, the above apparatus can also include an electromagnet apparatus, set at the last sections of both ends of the watch band. When the electromagnet apparatus is in use, the monitoring apparatus monitors whether a mutual approaching distance between last sections of the watch band at both ends of the watch band reaches a preset distance; and the electromagnet apparatus is configured to be powered on under a condition that the mutual approaching distance reaches the preset distance, and quickly merge the last sections of both ends of the watch band through magnetic force after being powered on, to make the watch band to be closed up. In this way, the watch can be firmly worn on the wrist through the electromagnet apparatus, which avoids the loss caused by the watch falling off under the vigorous operation.

Because, in the embodiment the electromagnet apparatus is added, the cooperation of the electromagnet apparatus is also required when removing the watch band, then the monitoring apparatus monitors the temperature and the light intensity of the front surface of the watch dial after the electromagnet apparatus is powered on, to judge whether the temperature and the light intensity reach preset thresholds; under a condition that both the temperature and the light intensity indicated by the sensors reach the preset thresholds, the electromagnet apparatus is powered down, to remove the magnetic force and make the last sections of both ends of the watch band to be separated. During implementation, the above electromagnet apparatus can include a battery in the watch dial, a wire loop in the watch band, and an electromagnet deployed in the last section of the watch band, and those skilled in the art can change its deployment position according to the actual requirement.

After the above powering down, and after the last sections of both ends of the watch band are separated, the watch band can be retracted through the mechanical transmission apparatus to take off the watch. Herein, the mechanical transmission apparatus can include: a motor and a gear set in the watch dial, and a plurality of rollers and belts set in the watch band, with the belts wrapped out of the plurality of rollers; herein, the motor is arranged to drive the gear to rotate, and the gear drives the belts, to realize retraction of multi-sections of the watch band.

Alternatively, the sections of the above watch band can be divided into two sections or three sections, and the numbers of the temperature sensor and the optical sensor are preferably 4; the numbers of two kinds of sensors can be the same or different during the setting, the sensors can be set in the same positions, and can also be set in different positions, or the two kinds of sensors can be integrated to form a sensor, etc.

Figure 2:
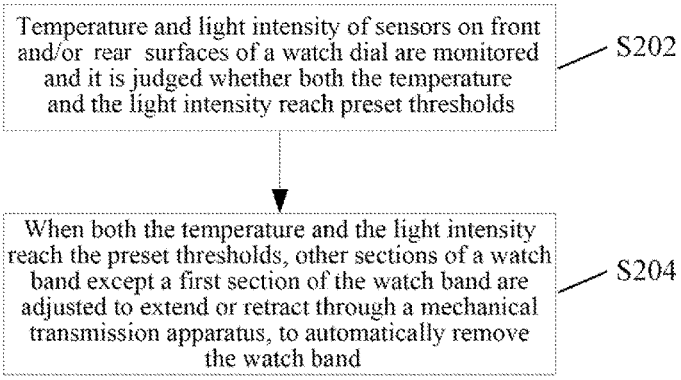
FIG. 2 is a flow chart of an automatic wearing method for a smart watch according to an embodiment of the present document.

The embodiment of the present document further provides an automatic wearing method for a smart watch. The method is applied to the above smart watch, and the process is shown in FIG. 2, including step S202 to step S204.

In step S202, temperature and light intensity of sensors on front and/or rear surfaces of a watch dial are monitored and it is judged whether both temperature and light intensity reach preset thresholds, herein, the sensors include: temperature sensors and optical sensors.

In step S204, other sections of a watch band except a first section of the watch band are adjusted to extend or retract when both the temperature and the light intensity reach the preset thresholds through a mechanical transmission apparatus, to automatically remove the watch band.

When monitoring the temperature and the light intensity of sensors on front and/or rear surfaces of the watch dial and judging whether both the temperature and the light intensity reach the preset thresholds, the sensors on the front and back can be respectively corresponding to different preset thresholds, therefore, the conditions required to be reached are different; for the sensors on the rear surface of the watch dial, it is judged whether the current temperature reaches the first preset temperature threshold and whether the current light intensity reaches the first preset light threshold; in order to achieve extending each section of the watch band from a cavity of a previous section of the watch band thereof through a mechanical transmission apparatus when both the current temperature and the current light intensity reach the above thresholds; for the sensors on the front surface of the watch dial, it is judged whether the current temperature reaches a second preset temperature threshold and whether the current light intensity reaches a second preset light threshold, in order to achieve retracting each section of the watch band from the cavity of the previous section of the watch band thereof through the mechanical transmission apparatus when both the current temperature and the current light intensity reach the above thresholds. In the above process, the first preset light threshold and the second preset light threshold can also be the same, and those skilled in the art can also set the sensors on front and rear surfaces to work alternately according to the demand to meet the requirement of automatic wearing, which will not be repeated here.

After extending each section of the watch band from the cavity of the previous section of the watch band through the mechanical transmission apparatus, when a mutual approaching distance between last sections of both ends of the watch band reaches a preset distance, an electromagnet apparatus is further able to be triggered to be powered on to generate magnetic force and quickly merge the last sections of both ends of the watch band, to make the watch band to be closed up. And when the monitoring apparatus monitors that the current temperature of the front surface of the watch dial reaches the second preset temperature threshold and the current light intensity reaches the second preset light threshold, then the sensors on the front surface are monitored and the electromagnet apparatus is controlled to be powered down to remove the magnetic force and make the last sections of both ends of the watch band to be separated.

Alternative Embodiments

The embodiment of the present document realizes automatic wearing a watch band by using monitoring and control functions of a smart watch, so as to enhance operating experience and operating convenience of the smart watch. In order to achieve the purpose to be realized, the main scheme adopted by the embodiment is as follows.

A monitoring apparatus is set on a watch dial of the smart watch, and a mechanical transmission apparatus and an electromagnet apparatus are set on the watch band of the smart watch; when the monitoring apparatus on the rear surface of the watch dial monitors that a startup condition of the watch band is satisfied, the mechanical transmission apparatus and the electromagnet apparatus are started, and the watch band is automatically extended and closed; when the monitoring apparatus on the front surface of the watch dial monitors that the startup condition of wearing the watch band is satisfied, the electromagnet apparatus is closed, and the mechanical transmission apparatus is started, and the watch band is automatically opened and retracted. The above scheme is further illustrated by combining the following accompanying drawings hereinafter.

Figure 3:
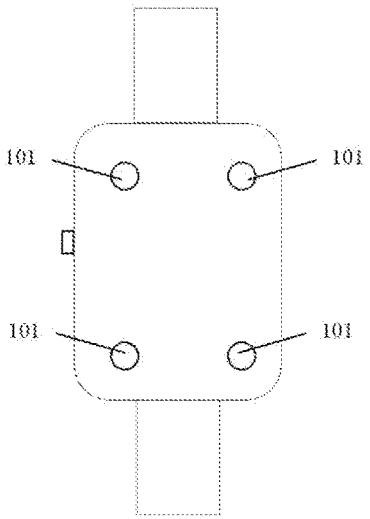
FIG. 3 is a position diagram of sensors deployed on back surface of a watch dial according to a preferred embodiment of the present document.
Figure 4:
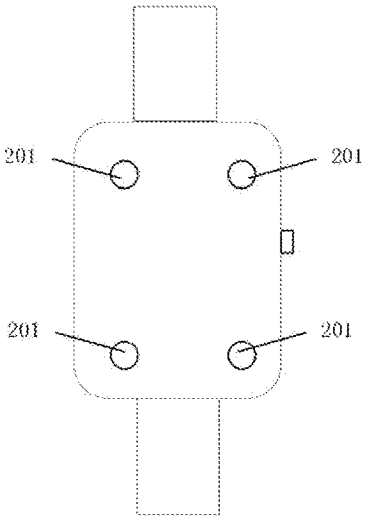
FIG. 4 is a position diagram of sensors deployed on front surface of a watch dial according to a preferred embodiment of the present document.

First, 4 points are set on the rear surface of the watch dial, as shown by 101 in FIG. 3, herein, each point is provided with a light sensor and a temperature sensor, and each point is set with thresholds (A, B), and a time threshold T1 that two conditions are satisfied at the same time; accordingly, 4 same points are also set on the front surface of the watch dial, as shown by 201 in FIG. 4, herein, each point is provided with a light sensor and a temperature sensor, and each point is set with thresholds (A, B), and a time threshold T2 that two conditions are satisfied at the same time. In actual use, the user can set whether to enable the automatic wearing function according to the actual situation.

Figure 5:
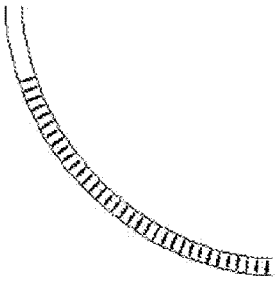
FIG. 5 is an amplifying close-up diagram of a lower watch band according to a preferred embodiment of the present document.

Further, the material used by the watch band in the present embodiment is a hard material, and the watch band is composed of two sections, and the upper half part of the watch band, for connecting the watch dial, is connected fixedly with the watch dial and is hollow; the lower half of the watch band is scalable, and can be retracted into the upper half of the watch band under the control of the mechanical transmission apparatus. Those skilled in the art can design the lower watch band into various styles, and the amplifying close-up of the lower watch band in the present embodiment is as shown in FIG. 5.

Figure 6:
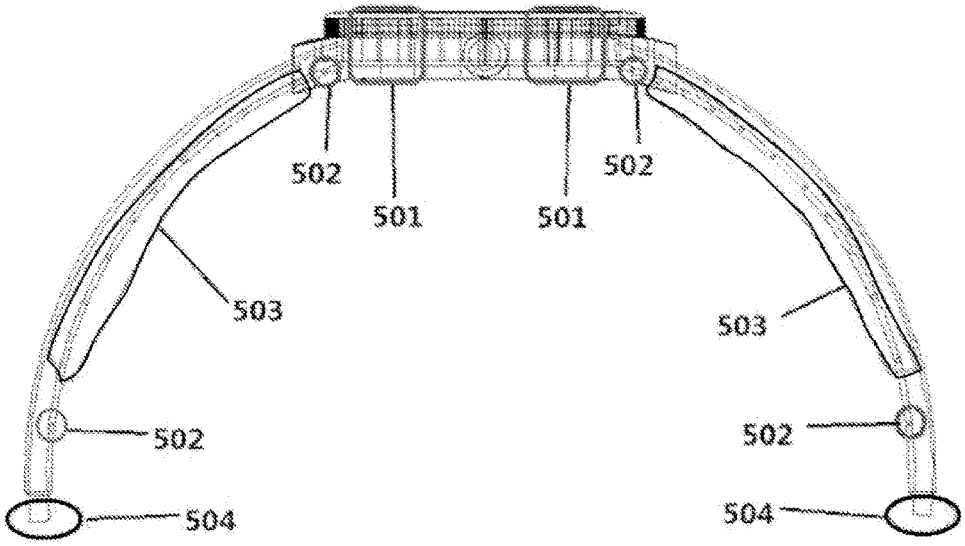
FIG. 6 is a diagram of an open watch band of a watch installed with a mechanical transmission apparatus according to an embodiment of the present document.
Figure 7:
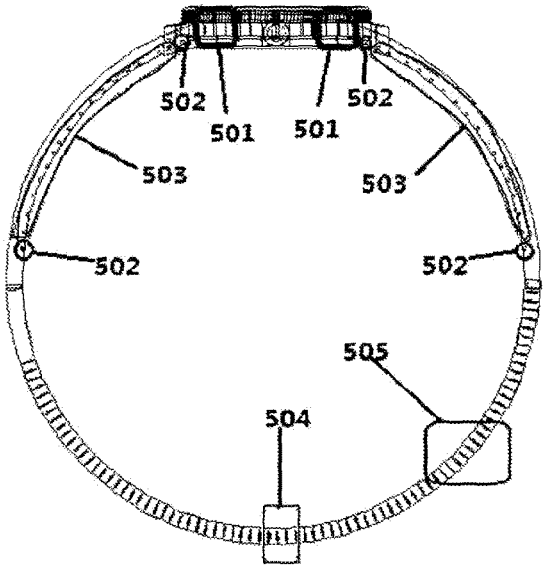
FIG. 7 is a diagram of a closed watch band of a watch installed with a mechanical transmission apparatus according to an embodiment of the present document.
Figure 8:
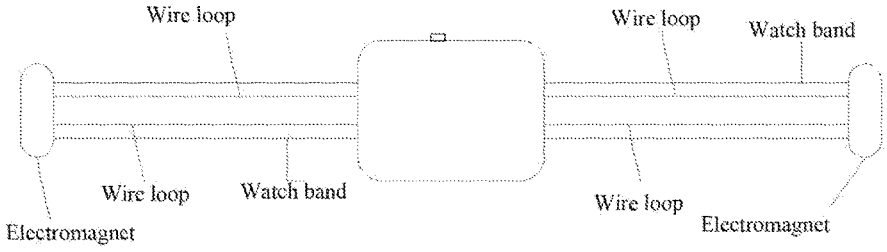
FIG. 8 is an installation principle diagram of an electromagnet apparatus according to an embodiment of the present document.

Further, the mechanical transmission apparatus is set between the watch dial and the watch band, FIG. 6 is a diagram of an open watch band of a watch installed with the mechanical transmission apparatus, and FIG. 7 is a diagram of a closed watch band of a watch installed with the mechanical transmission apparatus. As shown in FIGS. 6 and 7, the mechanical transmission apparatus is composed of small motors 501, gears 502 and rollers 503, various parts are connected by the belts, and the lower half of the watch band is designed with a rack 505 which is arranged to drive the lower half of the watch band to extend out when the gears rotate. The electromagnet apparatus 504 is added on the watch, and the electromagnet is composed of the battery in the watch dial, the wire loop in the watch band, and the electromagnet at the end of the watch band, as shown in FIG. 8. Herein, the mechanical transmission apparatus and the electromagnet apparatus are all apparatus arranged for controlling.

When the smart watch is in an initial state, the 4 sensors on the rear surface of the watch dial remain on, and the 4 sensors on the front surface are off. When wearing the watch, the watch dial is placed on the wrist, the light on the rear surface of the watch dial is blocked and the rear surface will contact the skin and feel the temperature; the sensors on the 4 points perform judgment through data monitored within time T, and the mechanical transmission apparatus is triggered when the light and temperature at the 4 points satisfy the thresholds (A, B) at the same time, to extend the lower watch band from the cavity of the upper watch band through the gears and belts; the electromagnet apparatus is triggered and controlled to be powered on when the both ends of the lower watch band will be merged, and the electromagnets at both ends of the watch band are enabled to generate the larger magnetic force to absorb the both ends firmly.

At this time, the controlling apparatus feeds back the state to the monitoring apparatus, and the monitoring apparatus monitors that the watch band has already been worn completely, and the processor stops the mechanical transmission apparatus, and stops working of the sensor on the rear surface of the watch dial, to complete wearing the watch band. The sensors on the rear surface of the watch dial need to be exposed to the light once again before they can be triggered to start again. At the same time to stop the working of the back sensors, the 4 sensors on the front surface of the watch dial begin to start.

When it is required to unlock the watch, the other palm is placed on the front surface of the watch dial, at that time, the light on the 4 points of the surface is blocked, and the temperature of palm is inducted; the sensors on the 4 points perform judgment through data monitored within time T, and the electromagnet apparatus is controlled to be powered down when the light and temperature at the 4 points satisfy the thresholds (C, D) at the same time, the electromagnet loses the magnetism and the watch band is loosen, and the mechanical transmission apparatus is triggered to control retracting the lower watch band to the cavity of the upper watch band through controlling the motors, the gears and the belts. When being fully retracted into the cavity, the mechanical transmission apparatus is stopped, and the working of the 4 sensors on the front surface of the watch dial is stopped. At that time, the user can use the hand to take off the watch, and the 4 sensors on the rear surface of the watch dial are opened again when the sensors on the back surface are exposed to the light again.

The embodiment of the present document adds a function of a smart watch, and improves the operating experience of the smart watch. Those skilled in the art can asymmetrically set the watch band during the setting, etc.

Although, for the purpose of giving typical examples, the alternative embodiment of the present invention is already provided, those skilled in the art will realize that various kinds of improvement, increase and displacement are possible, therefore, the above embodiment is not intended to limit the scope of the present document.

INDUSTRIAL APPLICABILITY

As mentioned above, a smart watch and automatic wearing method thereof provided by the embodiment of the present document have the following beneficial effects: it realizes the automatic wearing or removal of the watch band, improves the performance of the smart watch, and sufficiently achieves full intelligence, and resolves the problem that although the functions of existing smart watches are so powerful, the wearing and removal of a smart watch is not smart enough, and the user still needs to manually wear and remove the smart watch, the wearing procedure of the existing smart watch is the same as that of a normal watch, which greatly reducing user experience.

What we claim is:

1. A smart watch, comprising:

a watch dial, a watch band, a monitoring apparatus and a mechanical transmission apparatus;

wherein, a front surface and a rear surface of the watch dial are respectively set with sensors, and the sensors comprise: temperature sensors and optical sensors;

the watch band is made of a hard material and has a multi-section structure; and beginning from a first section of the watch band fixedly connected to the watch dial, each section of the watch band is a hollow cavity structure that accommodates a next section of the watch band, to enable all other sections of the watch band except the first section of the watch band to retract into previous sections of the watch band;

the monitoring apparatus is set in the watch dial, and arranged to monitor temperature and light intensity of the sensors on the front surface and/or the rear surface of the watch dial and judge whether the temperature and light intensity reach preset thresholds; and the mechanical transmission apparatus is set between the watch dial and the watch band, and is arranged to, when both the temperature and the light intensity reach the preset thresholds, control other sections of the watch band except the first section of the watch band to extend or retract, to automatically remove and wear the watch band.

2. The smart watch according to claim 1 wherein the monitoring apparatus is further arranged to monitor whether a mutual approaching distance between last sections of the watch band at both ends of the watch band reaches a preset distance; and the smart watch further comprises an electromagnet apparatus, arranged to be powered on under a condition that the mutual approaching distance reaches the preset distance, and quickly merge the last sections of both ends of the watch band through a magnetic force after being powered on, to make the watch band to be closed up.

3. The smart watch according to claim 2, wherein:

the monitoring apparatus is further configured to, after the electromagnet apparatus is powered on, monitor temperature and light intensity of the sensors on the front surface of the watch dial and judge whether the temperature and light intensity reach preset thresholds; and the electromagnet apparatus is further arranged to be powered down under a condition that both the temperature and the light intensity reach the preset thresholds, to remove the magnetic force and make the last sections of both ends of the watch band to be separated.

4. The smart watch according to claim 3, wherein, the mechanical transmission apparatus comprises:

a motor and a gear set in the watch dial, and a plurality of rollers and belts set in the watch band, wherein, the belts are wrapped out of the plurality of rollers; the motor is arranged to drive the gear to rotate, and the gear drives the belts, to realize retraction of a plurality of sections of the watch band.

5. An automatic wearing method for a smart watch, applied to the smart watch according to claim 3, comprising:

monitoring temperature and light intensity of sensors on a front surface and/or a rear surface of a watch dial, judging whether both the temperature and the light intensity reach preset thresholds; wherein, the sensors comprise: temperature sensors and optical sensors; and when both the temperature and the light intensity reach the preset thresholds, adjusting other sections of a watch band except a first section of the watch band to extend or retract through a mechanical transmission apparatus, to automatically remove the watch band.

6. The smart watch according to claim 3, wherein, the electromagnet apparatus comprises:

a battery in the watch dial, a wire loop in the watch band and an electromagnet set in the last section of the watch band.

7. The smart watch according to claim 2, wherein, the mechanical transmission apparatus comprises:

a motor and a gear set in the watch dial, and a plurality of rollers and belts set in the watch band, wherein, the belts are wrapped out of the plurality of rollers; the motor is arranged to drive the gear to rotate, and the gear drives the belts, to realize retraction of a plurality of sections of the watch band.

8. An automatic wearing method for a smart watch, applied to the smart watch according to claim 2, comprising:

monitoring temperature and light intensity of sensors on a front surface and/or a rear surface of a watch dial, judging whether both the temperature and the light intensity reach preset thresholds; wherein, the sensors comprise: temperature sensors and optical sensors; and when both the temperature and the light intensity reach the preset thresholds, adjusting other sections of a watch band except a first section of the watch band to extend or retract through a mechanical transmission apparatus, to automatically remove the watch band.

9. The smart watch according to claim 2, wherein, the electromagnet apparatus comprises:

a battery in the watch dial, a wire loop in the watch band and an electromagnet set in the last section of the watch band.

10. The smart watch according to claim 1, wherein, a number of the temperature sensors is 4, and a number of the optical sensors is 4.

11. The smart watch according to claim 10, wherein, the mechanical transmission apparatus comprises:

a motor and a gear set in the watch dial, and a plurality of rollers and belts set in the watch band, wherein, the belts are wrapped out of the plurality of rollers; the motor is arranged to drive the gear to rotate, and the gear drives the belts, to realize retraction of a plurality of sections of the watch band.

12. An automatic wearing method for a smart watch, applied to the smart watch according to claim 10, comprising:

monitoring temperature and light intensity of sensors on a front surface and/or a rear surface of a watch dial, judging whether both the temperature and the light intensity reach preset thresholds; wherein, the sensors comprise: temperature sensors and optical sensors; and when both the temperature and the light intensity reach the preset thresholds, adjusting other sections of a watch band except a first section of the watch band to extend or retract through a mechanical transmission apparatus, to automatically remove the watch band.

13. The smart watch according to claim 1, wherein, the mechanical transmission apparatus comprises:

a motor and a gear set in the watch dial, and a plurality of rollers and belts set in the watch band, wherein, the belts are wrapped out of the plurality of rollers; the motor is arranged to drive the gear to rotate, and the gear drives the belts, to realize retraction of a plurality of sections of the watch band.

14. An automatic wearing method for a smart watch, applied to the smart watch according to claim 13, comprising:

monitoring temperature and light intensity of sensors on a front surface and/or a rear surface of a watch dial, judging whether both the temperature and the light intensity reach preset thresholds; wherein, the sensors comprise: temperature sensors and optical sensors; and when both the temperature and the light intensity reach the preset thresholds, adjusting other sections of a watch band except a first section of the watch band to extend or retract through a mechanical transmission apparatus, to automatically remove the watch band.

15. The smart watch according to claim 1, wherein, the electromagnet apparatus comprises:

a battery in the watch dial, a wire loop in the watch band and an electromagnet set in the last section of the watch band.

16. An automatic wearing method for a smart watch, applied to the smart watch according to claim 15, comprising:

monitoring temperature and light intensity of sensors on a front surface and/or a rear surface of a watch dial, judging whether both the temperature and the light intensity reach preset thresholds; wherein, the sensors comprise: temperature sensors and optical sensors; and when both the temperature and the light intensity reach the preset thresholds, adjusting other sections of a watch band except a first section of the watch band to extend or retract through a mechanical transmission apparatus, to automatically remove the watch band.

17. An automatic wearing method for a smart watch, applied to the smart watch according to claim 1, comprising:

monitoring temperature and light intensity of sensors on a front surface and/or a rear surface of a watch dial, judging whether both the temperature and the light intensity reach preset thresholds; wherein, the sensors comprise: temperature sensors and optical sensors; and when both the temperature and the light intensity reach the preset thresholds, adjusting other sections of a watch band except a first section of the watch band to extend or retract through a mechanical transmission apparatus, to automatically remove and wear the watch band.

18. The automatic wearing method according to claim 17, wherein, monitoring temperature and light intensity of the sensors on a front surface and/or a rear surface of a watch dial, judging whether the temperature and the light intensity reach preset thresholds comprise:

monitoring the sensor on the rear surface of the watch dial, and judging whether the temperature reaches a first preset temperature threshold and the light intensity reaches a first preset light threshold, when both the temperature and the light intensity reach the above thresholds, extending each section of the watch band from a cavity of a previous section of the watch band through a mechanical transmission apparatus; and/or, monitoring the sensor on the front surface of the watch dial, and judging whether the temperature reaches a second preset temperature threshold and the light intensity reaches a second preset light threshold, when both the temperature and the light intensity reach the above thresholds retracting each section of the watch band from the cavity of the previous section of the watch band through the mechanical transmission apparatus.

19. The automatic wearing method according to claim 18, after extending each section of the watch band from the cavity of the previous section of the watch band through the mechanical transmission apparatus, further comprising:

when a mutual approaching distance between last sections of both ends of the watch band reaches a preset distance, triggering an electromagnet apparatus to be powered on, to generate a magnetic force and quickly merge the last sections of both ends of the watch band, to make the watch band to be closed up.

20. The automatic wearing method according to claim 19, before retracting each section of the watch band from the cavity of the previous section of the watch band through the mechanical transmission apparatus, further comprising:

under a condition that the temperature of the front surface of the watch dial reaches the second preset temperature threshold and the light intensity reaches the second preset light threshold, controlling the electromagnet apparatus to be powered down, to remove the magnetic force and make the last sections of both ends of the watch band to be separated.

* * * * *